US005590673A

United States Patent [19]

Earnshaw

[11] Patent Number: 5,590,673

[45] Date of Patent: Jan. 7, 1997

[54] TILTING UMBRELLA FRAME

[75] Inventor: John M. Earnshaw, Huddersfield, United Kingdom

[73] Assignee: Hoyland Fox Limited, Penistone, United Kingdom

[21] Appl. No.: 438,490

[22] Filed: May 10, 1995

[30] Foreign Application Priority Data

May 11, 1994 [GB] United Kingdom ..... 9409356

[51] Int. Cl.[6] ..... A45B 11/00

[52] U.S. Cl. ..... 135/20.1; 135/27; 135/19.5; 135/20.3

[58] Field of Search ..... 135/20.1, 20.3, 135/15.1, 19.5, 27, 28

[56] References Cited

U.S. PATENT DOCUMENTS

| | | | |
|---|---|---|---|
| 96,777 | 11/1869 | Clyde | 135/20.1 |
| 738,554 | 9/1903 | Lingel | 135/20.1 |
| 835,306 | 11/1906 | Mangelsdorf | 135/20.1 |
| 1,996,071 | 4/1935 | Kahn | 135/20.1 |
| 2,671,459 | 3/1954 | Henderson | 135/20.1 |
| 3,850,186 | 11/1974 | Weber et al. | 135/20.3 |
| 3,926,202 | 12/1975 | Uthemann et al. | 135/20.3 |
| 4,878,509 | 11/1989 | Tung | 135/20.3 |
| 5,086,797 | 2/1992 | Earnshaw et al. | 135/20.1 |
| 5,433,233 | 7/1995 | Shiran et al. | 135/20.1 |

FOREIGN PATENT DOCUMENTS

| | | |
|---|---|---|
| 368539 | 5/1990 | European Pat. Off. . |
| 718517 | 1/1932 | France . |
| 756598 | 12/1933 | France . |
| 2202141 | 9/1988 | United Kingdom . |

*Primary Examiner*—Wynn E. Wood

*Attorney, Agent, or Firm*—Antonelli, Terry, Stout & Kraus, LLP

[57] ABSTRACT

A frame for an umbrella has a shaft in two parts 4, 5 connected by a joint 1. Stretchers 6 extend from a runner 2 on the lower shaft part 5 to attachment points on the ribs. A sleeve 10 is located loosely on the upper shaft part so that it can slide over the joint and lock it in the straight configuration. To provide easy access to the sleeve in order to be able to lift it off the joint and allow the shaft to tilt, the runner 2 has an operating rod 30 which allows a user to lift the sleeve without putting his fingers through the stretchers 6.

10 Claims, 1 Drawing Sheet

TILTING UMBRELLA FRAME

FIELD OF THE INVENTION

The invention concerns an umbrella frame having a shaft which can be tilted so that, in use, the umbrella cover will be at an inclination to the shaft. Such a construction finds wide use, e.g. for garden or fishing umbrellas.

BACKGROUND OF THE INVENTION

The traditional kind of tilting umbrella has a shaft at whose upper end is a so-called notch on which are pivoted the ribs which support the cover. The ribs themselves are held up, in the erected position of the umbrella, by a corresponding number of stretchers attached pivotally at one end to the ribs and at the other, again pivotally, to a runner which can slide along the shaft in order to fold and unfold the umbrella. In the upper position of the runner, with the umbrella unfolded, the runner is held in place by a catch. In order to provide the required tilting facility for the umbrella, a joint is provided in the shaft at a point below the upper position of the runner.

While this arrangement does allow the head of the umbrella to tilt with respect to the shaft, it has a number of disadvantages, most notably that, during folding and unfolding of the umbrella, the runner tends to catch on the joint. The presence of a tilting joint in the shaft also allows play in the umbrella, and the fact that the entire head of the umbrella, from the tilting joint upwards, is inclined when the tilt facility is used, means that the centre of gravity of the umbrella is displaced some way off the shaft axis, leading to instability and difficulties in handling especially in windy conditions. Further, the joint itself must fit within the confines of the shaft diameter, since the runner has to pass over it to fold and unfold the umbrella. This limits both the strength and the configuration of the joint.

An umbrella frame overcoming these disadvantages has been proposed in EP-A1-368539 U.S. Pat. No. 5,086,797. In this frame, known as the "head-tilt" frame, the tilting joint is located at a position between the top of the shaft and the runner. This means among other things that the joint can be much more robust than previously, and also that various kinds of joints, which otherwise would be unsuitable for umbrella frames, are now available for use. In particular EP 368539 envisages the use of a special design of ball-and-socket joint.

While the frame of EP 368539 has proven highly successful, it still has a minor weakness in that the tilt joint can be activated unintentionally by strong winds, even if the ball-and-socket joint has retaining lugs to keep the shaft straight.

SUMMARY OF THE INVENTION

It is an object of this invention to provide a device which can retain the joint of a head-tilt umbrella in the desired configuration, even in strong winds.

According to the invention there is provided an umbrella shaft having upper and lower parts connected by a tilting joint, and, on the lower shaft part, a location body from which, in the erected state of the umbrella, stretchers extend to hold the umbrella cover taut; the shaft further comprising a locking means for locking the joint in the aligned configuration and releasing it when the shaft is to be tilted, this locking means being operable from below the location body.

In general the location body will be a runner slidable up and down the lower shaft part to allow collapsing and erecting of the umbrella. The locking means can simply be a sleeve or rod sliding on the upper or lower shaft part, located or having a part located in the immediate vicinity of the joint and locking the joint in one position and allowing tilting in the other. Since for most umbrellas of this type the runner in the erected position approaches close to the joint, it will normally be more convenient to have the sleeve on the upper shaft part, which means that in its lower position it will cover the joint and prevent tilting, and in its upper position it frees the joint enough to allow the tilt.

Since the invention relates to umbrellas with the tilting joint above the runner (or locating ring for the stretchers, if the umbrella is not collapsible), the locking sleeve is not easily accessible by the user since the stretchers will be in the way. In order to operate the lock, therefore, an operating member is preferably provided which enables the user to move the sleeve into and/or out of the locking position. This member can simply be a rod guided within or on the runner, advantageously held by friction against the runner, in particular by virtue of its fitting tightly in a bore in the runner; however, a catch could also be used. The lower end of the rod can be operated by the user since it protrudes below the stretchers and the top end can then act to displace the sleeve or locking rod from its locking position.

The sleeve is preferably urged into its locking position by the force of gravity, although other means such as spring-loading are also conceivable.

When the location body is a runner movable up and down the shaft between the erected and folded configurations of the umbrella, it is held in place in the erected position by a catch; this catch may be in the conventional position on the shaft, but it may also, according to one advantageous feature, be at a position close to the joint, the runner being of a special design incorporating a catch in the form of a button, engaging on the ledge on the shaft and releasable by one hand by the user while grasping the runner. The advantage of this is that the main shaft part is a simple tube, the catch part being incorporated into the joint region, which eases manufacture considerably.

In theory the invention could be used for a permanent or semi-permanent umbrella-type canopy where the location body for the stretchers is not necessarily slidable up and down the pole; the same type of operating member could, however, be used.

Although the standard single-axis type of tilt joint could be used, the joint is advantageously a ball-and-socket joint, as described for instance in EP 368539. Such a joint is particularly advantageous because in this case the constraints on the design of the joint are far less stringent, as at no time does the runner have to pass over the joint which can therefore be locally of larger diameter than the shaft. In this case the locking member is preferably a stepped sleeve having two different-diameter sections, one fitting the upper shaft part and one of larger diameter encompassing the joint when the sleeve is lowered so as to fix the joint in the aligned, usually straight, configuration. To this end the relevant part of the joint, preferably the socket component when located in the lower shaft part, has a cylindrical outer form fitting closely in the corresponding sleeve section.

BRIEF DESCRIPTION OF THE DRAWINGS

Embodiments of the invention will now be described, by way of example, with reference to the accompanying drawings, in which:

The Figures show an embodiment of the invention, FIG. 1 showing the locking sleeve in the locked position, and FIG. 2 showing the frame with the locking sleeve raised ready for tilting.

DETAILED DESCRIPTION

Figure 1:
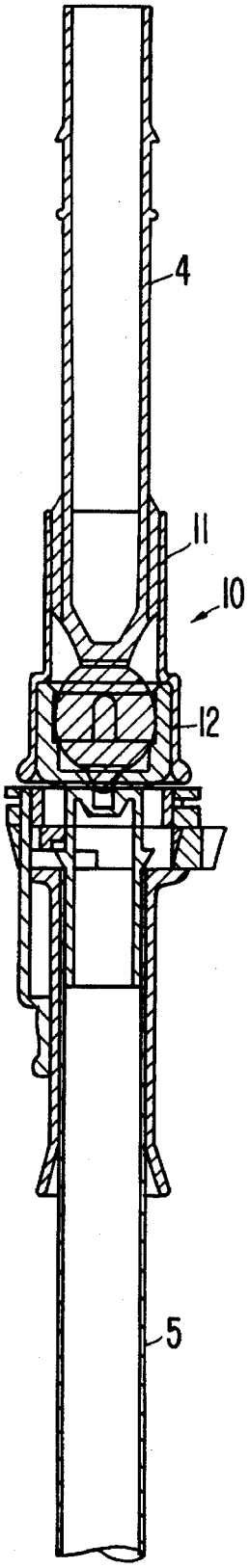
Figure 2:
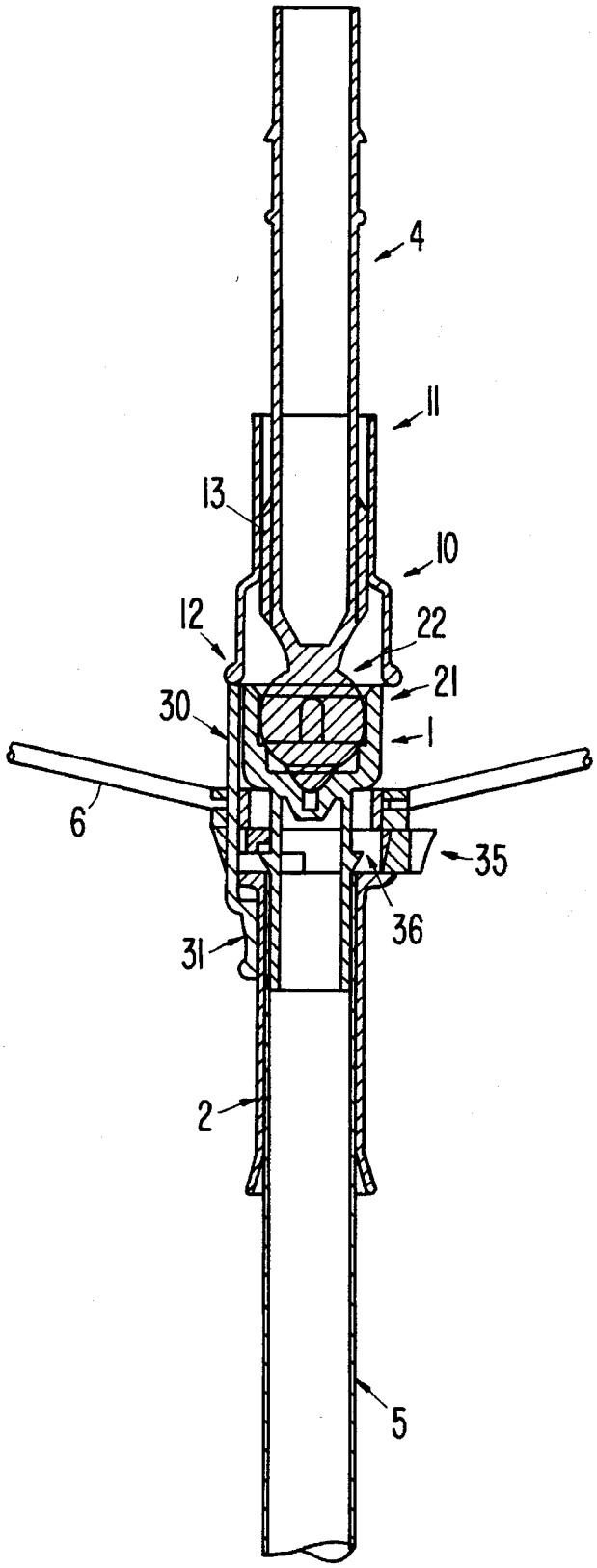

FIGS. 1 and 2 show the runner and joint region of a tilting umbrella which has a shaft 5 having an upper, tiltable, part 4, a number of struts or stretchers 6 extending from a sliding runner 2 on the shaft to the ribs which are not shown. The joint 1 in the shaft is located between the runner 2, which forms the location body for the stretchers 6, and the notch (not shown), as described in the above mentioned EP 368539.

For the joint 1, a flush joint, i.e. one which lies within the shaft cross-section when straight, could be used, allowing approximately 45° rotation in a single plane, i.e. about a single axis. However, as shown, it is preferable to use a universal joint, such as a ball-and-socket joint, which in the embodiment shown has a ball 22 attached to the upper shaft part 4 and a corresponding socket 21 forming the top of the lower shaft part 5. This kind of joint allows the user to change both the direction and the angle of tilt without altering the angular position of the shaft of the umbrella. This has the advantage that if the cover is asymmetrical, e.g. has an oval or rectangular shape, the umbrella can be adjusted on site so that the end or edge of the cover is lowermost, as usually required.

The runner 2 slides on the lower shaft part 5, and is shown in the Figures in the uppermost position with the umbrella erected, in which a ring-like spring loaded catch 35, fitted in the runner, is located on a lip 36 on the shaft.

The assembly further includes a locking element 10 in the form of a sleeve. This locking element serves to hold the two shaft parts 4, 5 in alignment, so that the umbrella cannot be blown into the tilted configuration by the wind. The sleeve sits loosely on the upper shaft part 4, guided by ribs 13 on the shaft, so that in the absence of other forces it falls into the lower position shown. The sleeve has an upper, narrower section 11 merging into a lower, wider section 12. The wider section corresponds in internal diameter to an outer, cylindrical part of the socket of the ball joint and the narrower section to the upper shaft part 4; the lowermost position of the sleeve is thus determined by the point at which the interior of the narrower section abuts against the socket outline. In this position, therefore, the joint cannot tilt.

If the sleeve 10 is lifted, as shown in FIG. 2, the wider section 12 rides clear of the socket, and the ball joint is then freed to allow tilting of the umbrella, for instance simply by pulling the head over. Sleeves operating in this way are known in principle for standard tilting umbrellas where the joint is below the runner. However, in practice, with the tilt above the runner, it is difficult to get at the sleeve to lift it off the joint because access is obstructed by the stretchers 6. In accordance with the invention therefore the umbrella is further provided with an operating member 30, here simply a rod mounted in a bore in the runner 2 and able to slide parallel to the shaft.

The rod 30 can slide by an amount corresponding to the height by which the wider section 12 covers the socket 21, and a stop may be provided to indicate this amount of travel. Because the rod protrudes downwards through the wider top section of the runner to which the stretchers are attached, and down into the grip area, it can easily be manipulated by the user, by way of a broadened or buttoned part 31 at its lower end. It has a tight fit in the runner so that it stays put after being moved.

The rod 30 acts on the lower edge of the sleeve 10 10, moving parallel to the shaft at a distance from the axis which is adequate to allow the rod to clear the socket 21. Hence upward movement of the rod 30 carries the sleeve 10 with it; the normal movement required to free the joint is a few centimetres. The top part 4 of the shaft can then be tilted, the sleeve 10 riding further up if necessary to clear the rod or the socket. The frictional setting of the rod 30 frees the user to tilt the umbrella, but the rod could in principle be loose. Other embodiments of the sleeve-lifting mechanism are of course possible: the rod could pull the sleeve down to lock the joint, though here a biasing means would be needed to maintain the upright position of the sleeve when released; if the ball-and-socket joint were the other way up, with the ball on the lower shaft 5, the sleeve could be correspondingly inverted.

It will be seen that the rod 30 does not interfere with the normal operation of the runner 2. In order to fold up the umbrella the upper shaft 4 has to be in the upright (untilted) condition, and then the runner is released from the lip 36 and slid down the shaft 5.

Embodiments are conceivable in which no sleeve is provided, even in sketched form, but a rod-like member operable by the user simply interferes with the tilting of the joint when urged into place. In the ball-and-socket joint, for example, the socket shell could have a hole through which a corresponding rod passes and the ball could have a recess into which the end of the rod engages. A rod could even be arranged to pass up the interior of the shaft. Alternatively the operating member for the locking member could, instead of being a separate piece, be constituted by the owner itself; the runner would have to be movable into an extreme upper position in which it engages the upper part of the joint.

I claim:

1. An umbrella frame, comprising:

an upper shaft member;

a lower shaft member;

a tiltable joint member joining said upper shaft member and said lower shaft member and permitting said upper shaft member alternatively to be aligned with said lower shaft member and to be tilted relative to said lower shaft member;

a location body slidably mounted on said lower shaft member, for supporting a plurality of stretchers extending to umbrella ribs to hold an umbrella cover taut; and locking means actuable between a locked position in which said joint member is locked with said upper shaft member aligned with said lower shaft member, preventing tilting of said upper shaft member relative to said lower shaft member, and an unlocked position in which said joint member is unlocked, permitting tilting of said upper shaft member relative to said lower shaft member, said locking means being operable from below the attachment of the stretchers on said location body.

2. An umbrella frame according to claim 1, in which said locking means comprises a sleeve slidable between the locked position in which said upper joint member and said lower point member are held in alignment and the unlocked position in which said joint member is free to tilt.

3. An umbrella frame according to claim 2, in which said sleeve is slidably mounted on said upper shaft member and is slidable to lower, locked, position in which said sleeve engages over the upper end of said lower shaft member.

4. An umbrella frame according to claim 1, in which said locking means includes an operating member extending below the attachment of the stretchers on said location body and actuatable by a user so as to unlock and permit locking of said joint member.

5. An umbrella frame according to claim 4, in which said operating member Comprises a rod located in or on said location body and slidable parallel to the axis of said lower shaft member.

6. An umbrella frame according to claim 5, in which said rod fictionally engages said location body so that said rod can be moved by the user but otherwise remains in a set position.

7. An umbrella frame according to claim 1, in which said joint member comprises a ball-and-socket joint, the ball being attached to said upper shaft member by a neck, and the socket being attached to said lower shaft member and being in the form of a cup, open in a direction away from said lower shaft member.

8. An umbrella frame according to claim 3, in which said joint member comprises a ball-and-socket joint, the ball being attached to said upper shaft member by a neck, and the socket being attached to said lower shaft member and being in the form of a cup, open in a direction away from said lower shaft member.

9. An umbrella frame according to claim 8, in which said sleeve has a stepped cylindrical form, with a smaller-diameter part fitting round said upper shaft member and a larger-diameter part fitting the socket of said joint member when in the locked position.

10. An umbrella frame according to claim 4, in which said joint member comprises a ball-and-socket joint, the ball being attached to said upper shaft member by a neck, and the socket being attached to said lower shaft member and being in the form of a cup, open in a direction away from said lower shaft member.

* * * * *